US005909079A

United States Patent [19]

Uchida et al.

[11] Patent Number: 5,909,079

[45] Date of Patent: Jun. 1, 1999

[54] COLOR CATHODE RAY TUBE

[75] Inventors: Go Uchida; Syoji Shirai, both of Mobara, Japan

[73] Assignee: Hitachi, Ltd., Tokyo, Japan

[21] Appl. No.: 09/004,276

[22] Filed: Jan. 8, 1998

Related U.S. Application Data

[63] Continuation of application No. 08/727,753, Oct. 8, 1996, Pat. No. 5,731,657, which is a continuation-in-part of application No. 08/685,005, Jul. 22, 1996, Pat. No. 5,708,322, which is a continuation of application No. 08/332,788, Nov. 2, 1994, Pat. No. 5,572,084, which is a continuation-in-part of application No. 08/049,346, Apr. 21, 1993, abandoned, and application No. 08/685,005, which is a continuation of application No. 08/332,788, which is a continuation-in-part of application No. 08/049,346.

[30] Foreign Application Priority Data

Apr. 21, 1992 [JP] Japan ..... 4-191361
Nov. 16, 1993 [JP] Japan ..... 5-286772

[51] Int. Cl.[6] ..... H01J 29/50

[52] U.S. Cl. ..... 313/414; 313/412

[58] Field of Search ..... 313/414, 412, 313/426, 432, 460

[56] References Cited

U.S. PATENT DOCUMENTS

| | | |
|---|---|---|
| 3,984,723 | 10/1976 | Gross et al. . |
| 4,275,332 | 6/1981 | Ashizaki et al. . |
| 4,370,592 | 1/1983 | Hughes et al. . |
| 4,388,552 | 6/1983 | Greninger . |
| 4,412,149 | 10/1983 | Say . |
| 4,510,413 | 4/1985 | Yabe et al. . |
| 4,535,266 | 8/1985 | Say . |
| 4,542,318 | 9/1985 | Say . |
| 4,581,560 | 4/1986 | Shirai et al. . |
| 4,614,894 | 9/1986 | Izumida . |
| 4,622,491 | 11/1986 | Izumida et al. . |
| 4,626,738 | 12/1986 | Gerlach . |
| 4,800,318 | 1/1989 | Naiki . |
| 4,833,364 | 5/1989 | Izumida et al. . |
| 4,843,278 | 6/1989 | Lau . |
| 4,978,886 | 12/1990 | Miyamoto et al. . |

(List continued on next page.)

FOREIGN PATENT DOCUMENTS

| | | |
|---|---|---|
| 56-13644 | 10/1981 | Japan . |
| 58-184241 | 10/1983 | Japan . |
| 58-216342 | 12/1983 | Japan . |
| 62-274533 | 11/1987 | Japan . |
| 63-32838 | 2/1988 | Japan . |
| 63-69128 | 3/1988 | Japan . |
| 7-141999 | 6/1995 | Japan . |
| 2027269 | 2/1980 | United Kingdom . |

*Primary Examiner*—Ashok Patel
*Attorney, Agent, or Firm*—Antonelli, Terry, Stout & Kraus, LLP

[57] ABSTRACT

A color cathode ray tube equipped with an in-line electron gun for emitting three electron beams includes a main lens made up of two cylindrical electrodes arranged in a spaced relationship. Each of the electrodes has an opening and having therein a plate electrode with a beam passing area. The electrodes are given different voltages, wherein D and S have values in a region where all of the following inequalities are satisfied;

$$S \leqq 5.0$$

$$S < D,$$

and $$145.5 \leqq 55S - 20D$$

S being a beam spacing in mm between central axes of the three adjacent electron beams at the main lens, and D being a dimension in mm related to a distance of a center of at least one of the in-line arrangement of the three electron beams to an inner edge of at least one of the two cylindrical electrodes.

37 Claims, 11 Drawing Sheets

U.S. PATENT DOCUMENTS 5,142,189 8/1992 Sugahara et al. .
5,196,762 3/1993 Go .
5,212,423 5/1993 Noguchi et al. .
5,291,094 3/1994 Lee .
5,300,854 4/1994 Kweon .
5,350,967 9/1994 Chen .
5,414,323 5/1995 Uchida et al. .
5,434,471 7/1995 Jeong .
5,451,834 9/1995 Dho et al. .
5,488,265 1/1996 Chen .
5,512,797 4/1996 Kim et al. .
5,592,046 1/1997 Kim .
5,610,481 3/1997 Shirai et al. .
5,625,252 4/1997 Tsuzurahara et al. .

COLOR CATHODE RAY TUBE

CROSS REFERENCE TO RELATED APPLICATIONS

This application is a continuing application of U.S. application Ser. No. 08/727,753, filed Oct. 8, 1996, now U.S. Pat. No. 5,731,657, issued Mar. 24, 1998, which is a continuation-in-part application of U.S. application Ser. No. 08/685,005, filed Jul. 22, 1996, now U.S. Pat. No. 5,708,322, issued Jan. 13, 1998, which is a continuing application of Ser. No. 08/332,788, filed Nov. 2, 1994, now U.S. Pat. No. 5,572,084, issued Nov. 5, 1996, which is a continuation-in-part application of U.S. application Ser. No. 08/049,346, filed Apr. 21, 1993, now abandoned, and a continuing application of U.S. application Ser. No. 08/685,005, filed Jul. 22, 1996, now U.S. Pat. No. 5,708,322, issued Jan. 13, 1998, which is a continuing application of Ser. No. 08/332,788, filed Nov. 2, 1994, now U.S. Pat. No. 5,572,084, issued Nov. 5, 1996, which is a continuation-in-part application of U.S. application Ser. No. 08/049,346, filed Apr. 21, 1993, now abandoned.

BACKGROUND OF THE INVENTION

1. Field of the Invention

The present invention relates to a color cathode ray tube equipped with an in-line electron gun so constituted as to emit three electron beams in one horizontal line toward a fluorescent screen.

2. Description of the Prior Art

In a cathode ray tube equipped with at least an electron gun comprising a cathode and a plurality of grid electrodes, a deflection device, and a fluorescent screen, the following arts have been known to obtain a preferable reproduced image extending from the central portion to the periphery of the fluorescent screen: one for providing an astigmatic lens in a region of an electrode constituting a focusing lens (main lens), and the other for forming an electron beam passing hole of the main lens constituting electrode of an in-line electron gun into a slot and making the sizes of central and side electron beam passing holes different (Japanese Patent Laid-Open No. 64368/1976).

This type of color cathode ray tube, as shown in FIG. 1, is equipped with at least a vacuum vessel comprising a panel 61, a funnel 62, and a neck 63 which are made of an insulator such as glass, an electron gun 64, a shadow mask 65, and a fluorescent screen 66 contained in the vacuum vessel, and reproduces an image by impinging electron beams emitted from an electron gun 64 onto the fluorescent screen 66.

FIG. 2 is a sectional view of an essential portion of a main lens, schematically illustrating the structure of a conventional in-line electron gun used for the above cathode ray tube.

In FIG. 2, reference numerals 08, 09 and 010 are cathodes, 011 is a first grid electrode, 012 is a second grid electrode, 013 is a third grid electrode which is one of the electrodes constituting a main lens, 014 is a fourth grid electrode which is the other electrode constituting the main lens, 015, 016, and 017 are inner cylinders connected to the opening portions of the third grid electrode 013 on the fourth grid electrode 014 side, and 018, 019, and 020 are inner cylinders connected to the opening portions of the fourth grid electrode 014 on the third grid electrode 013 side. Numerals 021, 022, and 023 are central axes of electron beams, respectively and the central axis 022 of the center electron beam is aligned with the axis of the electron gun (tube axis). These central axes 021, 022, and 023 are aligned with the openings corresponding to the cathodes 08, 09, and 010 of the first, second, and third grid electrodes 011, 012, and 013, and with the central axes of the inner cylinders 015, 016, and 017 connected with the opening portions of the third grid electrode 013, and they are arranged on the same plane almost in parallel.

The central axes of the central opening portion of the fourth grid electrode 014 and the inner cylinder 019 connected to the central opening portion are aligned with the central axes 022. However, the central axes of the opening portions on the both sides and the inner cylinders 018 and 020 connected to the opening portions are not aligned with their corresponding central axes of the third grid electrodes, but they are slightly shifted outwards.

Symbol S in FIG. 2 represents the interval between central axes 021, 022 and 023 of the electron beams, L represents the distance between the central axes 021 and 023 of the outer electron beams and the inner wall of the neck, and D represents the inside diameter of the inner cylinder connected to the opening portion of the G3 electrode 013.

The in-line electron gun having the above constitution operates as shown below.

Thermionic electrons emitted from three cathodes 08, 09, and 010 heated by a heater are attracted toward the first grid electrode 011 by a positive voltage applied to the second grid electrode 012, and three electron beams are formed. Then, these three electron beams pass through the openings of the first grid electrode 011 and then through the opening of the second grid electrode 012. The beams are accelerated by positive voltages applied to the third grid electrode 013 and the fourth grid electrode 014, and enters the main lens.

In this case, a low voltage of approximately 5 to 10 kV is applied to the third grid electrode 013 constituting the main lens; a high voltage of approximately 20 to 35 kV to be applied to the fluorescent screen is applied to the fourth grid electrode 014 through a conductive film coated on the inner wall of the funnel 62. Therefore, a electrostatic field is formed between the third grid electrode 013 and fourth grid electrode 014 by the difference in voltage between the third grid electrode 013 to which the low voltage is applied and the fourth grid electrode 014 to which the high voltage is applied. Therefore, the paths of three electron beams in the main lens are bent by the electrostatic field. As a result, three electron beams are focused on the fluorescent screen.

Moreover, because the central axes of the opposing openings of cylinders for side beams of the third grid electrode 013 and fourth grid electrode 014 are not aligned with each other, the main lens for the side beams is not symmetric about the central axis. Therefore, the side electron beams are so deflected inward that they are converged in accordance with the center electron beam on the fluorescent screen. Thereby, three electron beams are converged on the fluorescent screen, images of three colors of R, G, and B generated by three electron beams are correctly registered, and a color image is displayed.

SUMMARY OF THE INVENTION

In an in-line electron gun constituted as described above, three electron beams do not satisfy the convergence conditions due to slight variations of the electron gun component accuracy and assembling accuracy. Therefore, it is necessary to make adjustment for convergence of electron beams.

In this convergence adjustment, as the beam spacing S between the electron beams decreases, deviation of the electron beams from the convergence conditions decreases and the adjustment gets easier. From past experiment results, it has been known that it is preferable to set the S value to less than approximately 5 mm.

In conventional focusing electrode structures, however, the opening diameter of the focusing electrode is restricted to a value smaller than the beam spacing S between the adjacent electron beams entering the lens. Therefore, a limit is put on the opening diameter for setting the beam spacing S between electron beams to be less than 5 mm.

The effective aperture of the focusing lens of each electron beam is determined by this opening diameter. Therefore, a problem arises that the spherical aberration of a lens increases and the electron beam spot diameter increases as the opening diameter decreases.

To solve the above problem, a structure is known which is disclosed in Japanese Patent Laid-Open No.103752/1983. This structure makes it possible to decrease the spherical aberration while the beam spacing S is maintained at less than 5 mm.

The structure of the electron gun disclosed in the above publication will be schematically described below, referring to FIGS. 3(*a*) and 3(*b*). FIG. 3(*a*) is a longitudinal sectional view of the essential portion, illustrating the main lens of an in-line electron gun and FIG. 3(*b*) is a transverse sectional view of the essential portion of FIG. 3(*a*), taken along the line A-A' of FIG. 3(*a*)

In FIGS. 3(*a*) and 3(*b*), reference numeral 13 is a third cylindrical grid electrode whose opening cross section is almost elliptic, 14 is a fourth cylindrical grid electrode whose opening cross section is also almost elliptic, 13-1 is a flat electrode provided in a third grid electrode 1, 14-1 is a flat electrode provided in a fourth grid electrode 2, 13R, 13G, and 13B are electron beam passing holes (openings) of the flat electrode 13-1, 14R, 14G, and 14B are electron beam passing holes (openings) of the flat electrode 14-1, and 21, 22, and 23 are central axes.

As shown in FIG. 3(*b*), the diameter D in the direction (vertical direction) perpendicular to the in-line direction (horizontal direction) of the openings 13R, 13G, and 13B of the flat electrode 13-1 of the third grid electrode 1 is approximately equal to the diameter of the main lens formed by the electrode. As the diameter D increases, the spherical aberration decreases and also the electron beam spot diameter decreases.

However, even in the above structure, another problem described below arises.

That is, to increase the vertical direction diameter D and to decrease the electron beam spot diameter at the fluorescent screen, it is necessary to increase the electron beam diameter in the main lens electrode. In this case, if the vertical direction diameter D is extremely larger than the beam spacing S of adjacent electron beams, a problem is caused that electron beams strike a flat electrode in the grid electrode, especially when the beams are of large currents.

It is an object of the present invention to provide a cathode ray tube equipped with an in-line electron gun causing no problem in convergence of three electron beams and allowing the main lens diameter to increase in such a way that the electron beams do not strike the flat electrode in the third grid electrode.

To achieve the above object, the present invention provides a color cathode ray tube equipped with an in-line electron gun comprising at least electron beam producing means for emitting three electron beams of in-line arrangement toward a fluorescent screen and main lens means for focusing the three electron beams on the fluorescent screen, being provided with a flat electrode having electron beam passing areas in two cylindrical electrodes which are arranged at an interval in the direction of the travel of the electron beams emitted from the electron beam producing means and have approximately-elliptic opening cross sections kept at different potentials, characterized in that when the distance between the centers of three adjacent electron beams is denoted by S (mm), the opening diameter of two cylindrical electrodes perpendicular to the in-line electron beam arrangement direction is denoted by D (mm), the above S and D meet the following relations:

$$S<5.00,$$

$$D>S,$$

and $$55\ S-20D \geqq 145.5$$

Moreover, the color cathode ray tube is characterized in that each of the mutually facing openings of the two cylindrical electrodes constituting the main lens means comprise a single opening for the three electron beams.

Furthermore, the color cathode ray tube equipped with an in-line electron gun constituted as described above may involve a problem that, if the distance between electron beams and the inner wall of the neck for housing the in-line electron gun is too small, the inner wall of the neck comes to a high potential due to the high voltage applied to the funnel portion of the color cathode ray tube, the electron beams are deflected due to an electric field produced by the high potential of the inner wall of the neck glass, and three electron beams are not converged on the fluorescent screen, when the color cathode ray tube is continuously operated for a long time.

To increase the distance between electron beams and the inner wall of the neck for housing the in-line electron gun, it is necessary to increase the neck diameter or decrease the beam spacing S of the adjacent electron beams.

However, if the neck diameter is increased, the funnel diameter also increases, the distance between the electron beams and the deflection yoke increases, and the deflection sensitivity of the deflection yoke is degraded.

If the beam spacing S is decreased, a problem is brought up that the distances decrease between the beams and the electrodes of the main lens separating the electron beams from each other in the main lens where the diameters of the electron beams are largest, and the electron beams strike the main lens electrode.

If the electron beam diameter in the main lens electrode is decreased to avoid the strike, a problem arises that the electron beam spot diameter on the fluorescent screen increases because the lens magnification decreases and the space charge effect increases. Moreover, if the beam spacing S is decreased, another problem arises that the spherical aberration of the main lens increases and the electron beam spot diameter on the fluorescent screen is further increased because the lens aperture D must be also decreased when the main lens is made up of the electrodes each having three circular openings as shown in FIG. 2.

It is another object of the present invention to provide a color cathode ray tube equipped with an in-line electron gun in which the above problems of the prior art are solved and the focus characteristic is improved by eliminating the influence of the potential of the neck inner wall and decreasing the static convergence drift under a long-time operation.

To achieve the above object, according to the present invention, a color cathode ray tube equipped with an in-line electron gun having electron beam generation means for emitting three electron beams toward a fluorescent screen and a main lens comprising two electrodes kept at different potentials and provided separately from each other in order to focus the three electron beams on the fluorescent screen, characterized in that when the outside diameter of the neck 63 (FIG. 1) for housing the in-line electron gun is denoted by T (mm), the beam spacings between the central axes of adjacent electron beams are denoted by S (mm), the above T and S meet the relations, $2S+14.6 \leqq T \leqq 25.3$, and the beam spacing S is 4.1 mm or more.

DETAILED DESCRIPTION OF THE PREFERRED EMBODIMENTS

The above constitution makes it possible to prevent problems from arising in convergence of three electron beams. And, because the structure shown in FIGS. 3(*a*) and 3(*b*) used for the main lens, and the diameter D in the direction perpendicular to the row of three electron beams, of the openings of the cylindrical electrode whose opening cross sections are approximately elliptic is almost equal to the main lens diameter formed by the electrode, it is possible to make the main lens diameter larger than those of conventional structures, to decrease the spherical aberration, and to decrease the electron beam spot diameter compared with conventional ones, by making the vertical direction diameter D larger than the beam spacing S between the centers of adjacent electron beams.

In an in-line electron gun, the diameter of the electron beams to be in a main lens must be increased as the main lens diameter increases in order to effectively use the main lens diameter. The reason is that the increase in the electron beam spot on the fluorescent screen due to the space charge effect must be prevented. However, if the electron beam diameter in the main lens is excessively increased, the electron beam spot diameter at the fluorescent screen is increased due to the lens aberration. That is, the electron beam diameter in the main lens has an optimum value.

Figure 4:
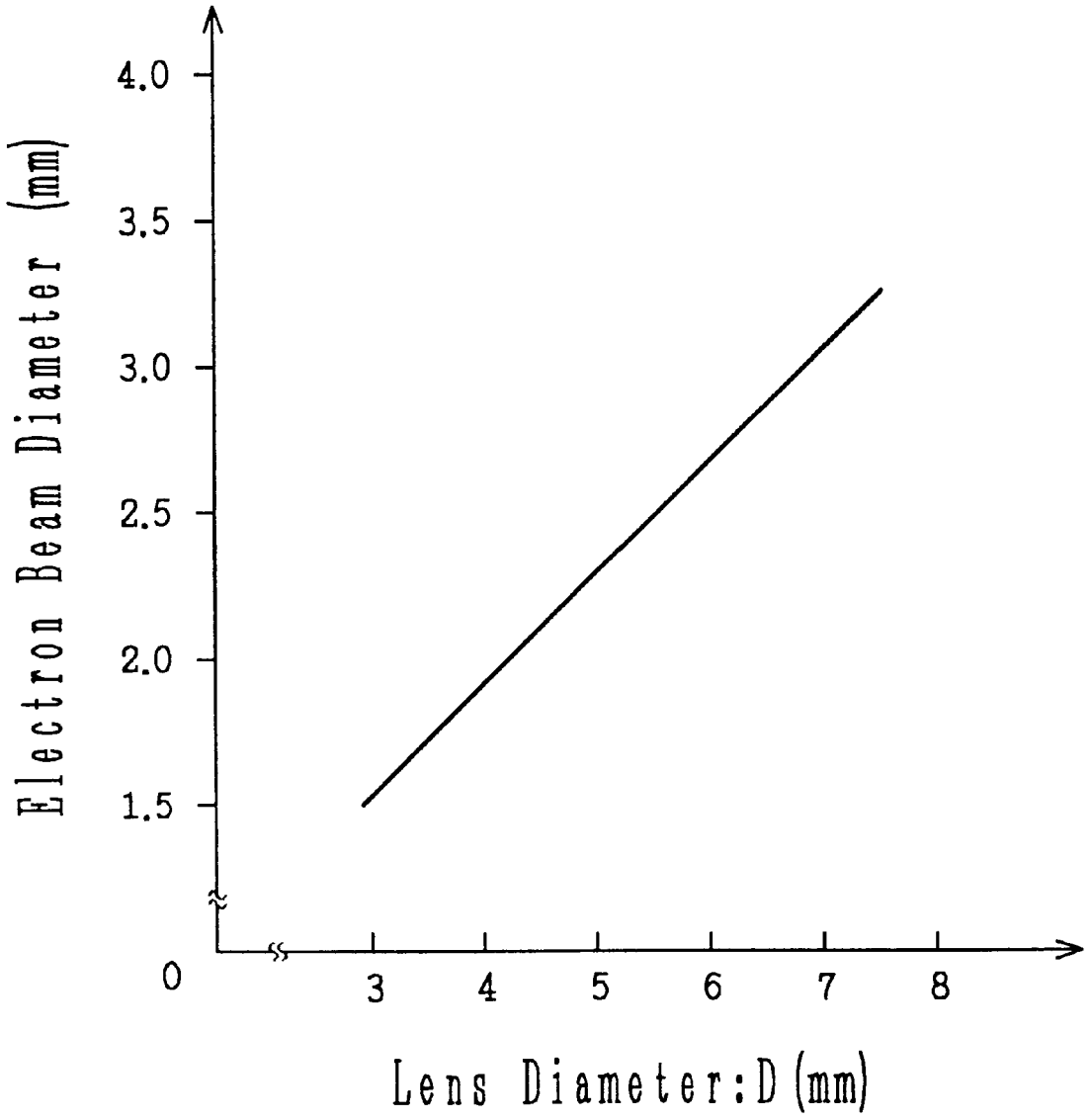
FIG. 4 is a graph showing the relationship between lens aperture and optimum diameter of the electron beam in the lens.

FIG. 4 is a graph showing the relationship between the lens diameter and the optimum diameter of the electron beam in the lens. In the graph, the values were obtained by the analysis when the fourth grid electrode voltage is 25 kV, the third grid electrode voltage is 7 kv, and the beam current value is 4 mA, in the case of a color cathode ray in which the screen diagonal is 51 cm and the deflection angle is 90°.

From the graph, it is found that the optimum electron beam diameter increases as the lens diameter increases.

Figure 3:
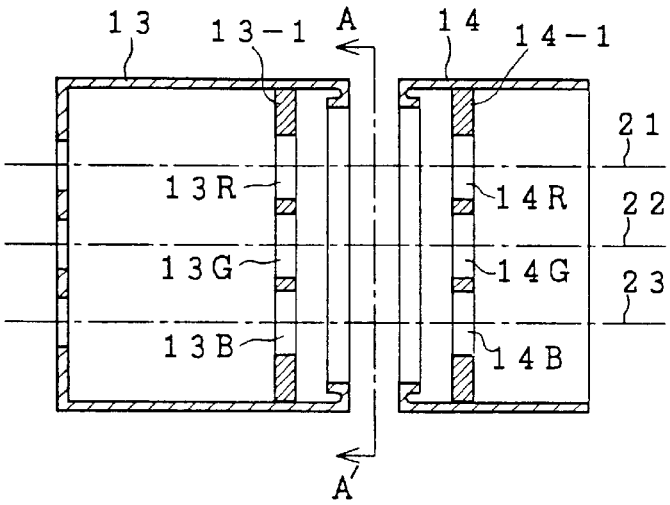
FIGS. 3(*a*) and 3(*b*) are sectional views for illustrating an essential portion of an electron gun applied to a color cathode ray tube equipped with an in-line electron gun of the present invention.
Figure 3:
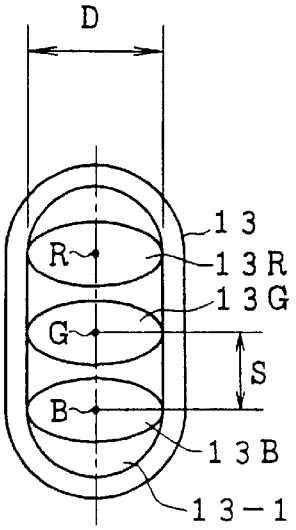
Figure 5:
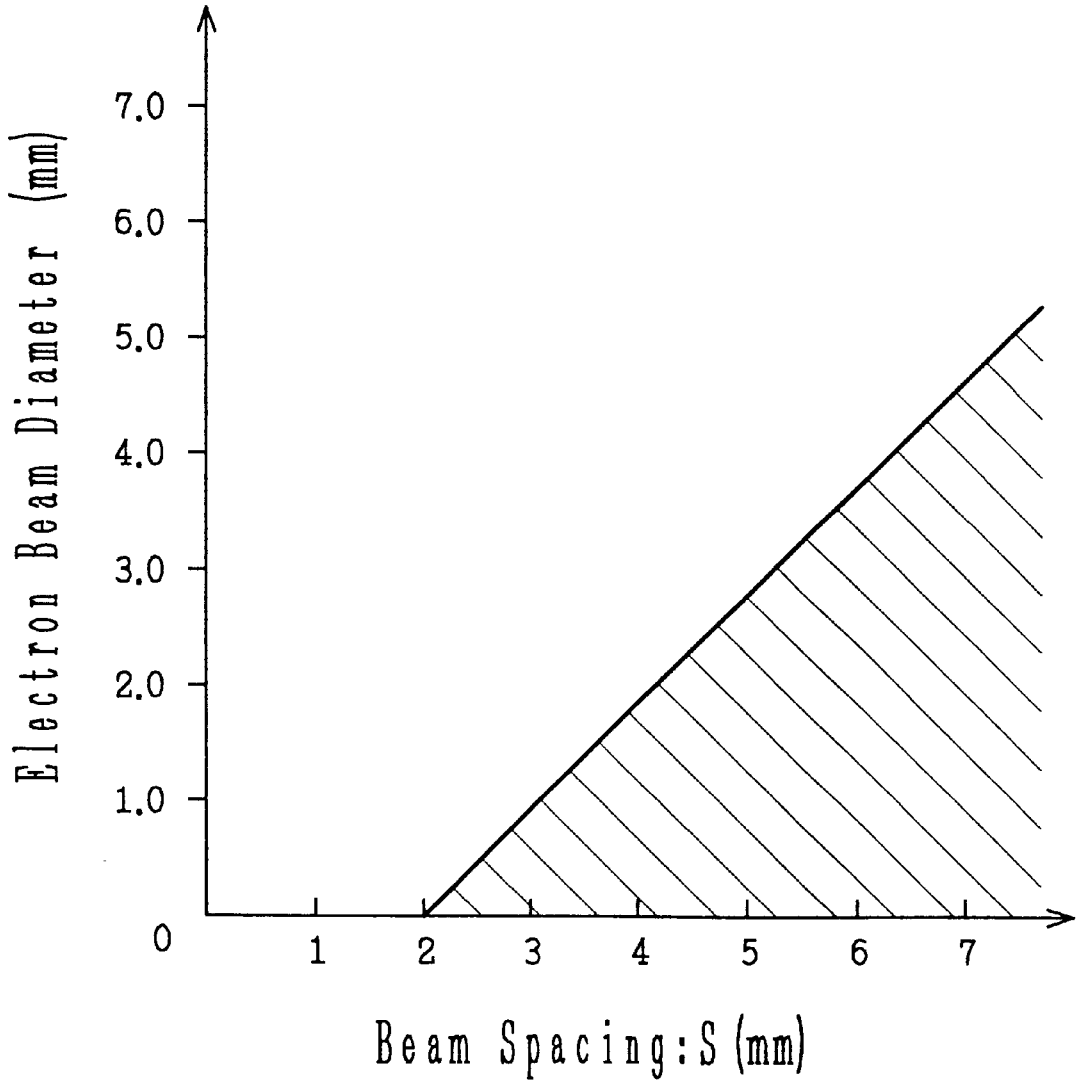
FIG. 5 is a graph showing the relationship between the beam spacing S of adjacent electron beams and the maximum electron beam diameter in a main lens in which no electron beam strikes a flat electrode provided in the cylindrical electrode.

In the electron gun having the main lens structure shown in FIGS. 3(*a*) and 3(*b*), however, if the diameter D in the direction perpendicular to the row of three electron beams at the openings is extremely larger than the beam spacing S, it is also necessary to increase the diameter of the electron beam supplied to the main lens in accordance with the increase of the diameter D, and thereby the electron beams strike a flat electrode in the cylindrical electrode when the beams are large currents. FIG. 5 is a graph showing the relationship between the beam spacing S and the maximum electron beam diameter in the main lens in which no electron beam strikes a flat electrode provided in the cylindrical electrode. In the area shaded by oblique lines in FIG. 5 where the electron beam diameter is smaller than the value shown by a solid lines, no electron beam strikes the flat electrode.

From the facts shown in FIGS. 4 and 5, the relationship between the beam spacing S and the lens diameter is obtained. The lens diameter corresponds to the vertical direction diameter D of the opening of the cylindrical grid electrode. Therefore, the relationship between the beam spacing S and the vertical direction diameter D of the opening of the cylindrical grid electrode is obtained.

Figure 6:
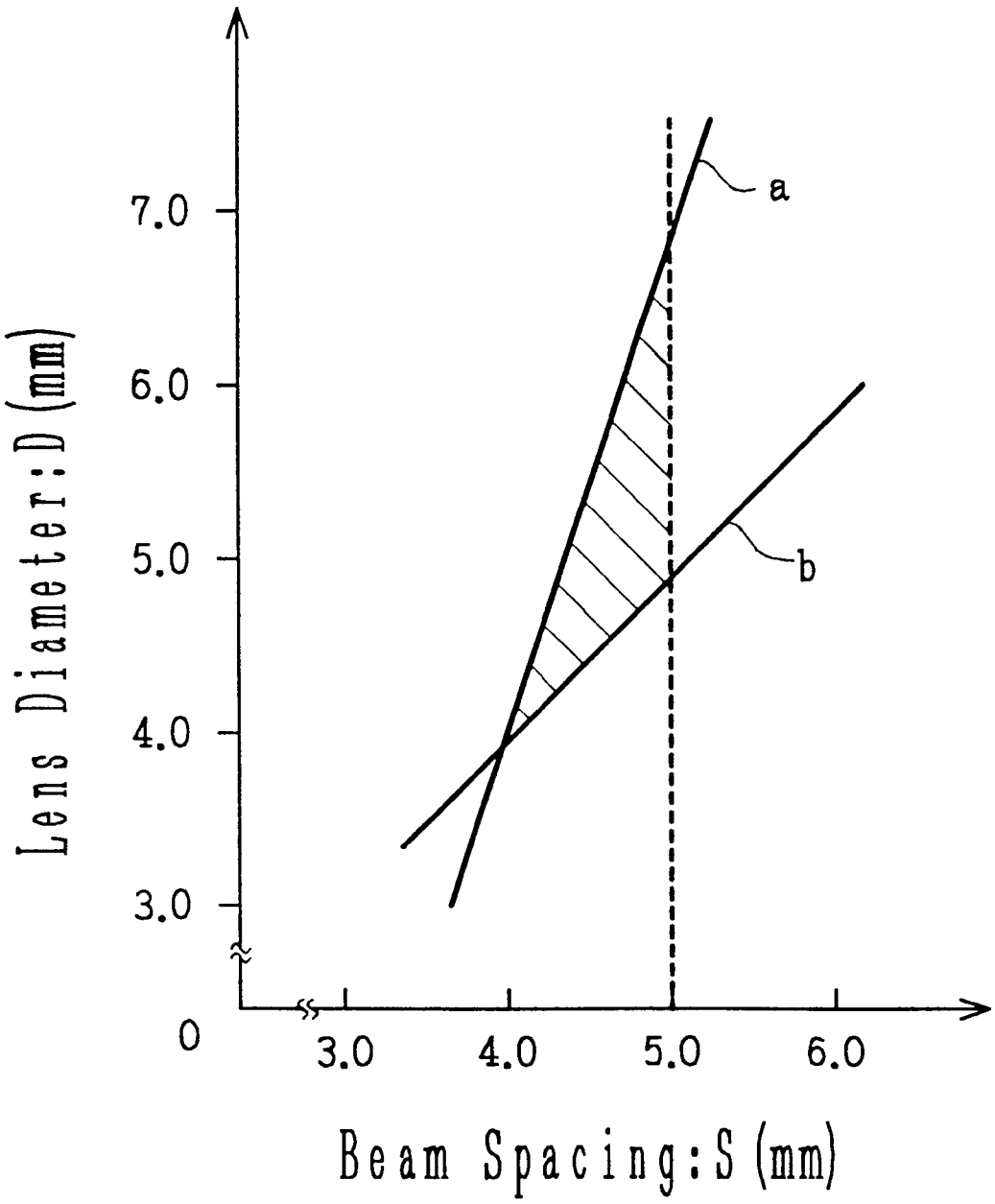
FIG. 6 is a graph showing the relationship between the beam spacing S and the vertical direction diameter D of the opening of the cylindrical grid electrode.

FIG. 6 is a graph showing the relationship between the beam spacing S and the vertical direction diameter D of the opening of the cylindrical grid electrode. In FIG. 6, the straight line "a" shows the relationship between the dimensions S and D obtained from the relationship between FIGS. 4 and 5 and the straight line "b" shows a line when S=D.

That is, the relationship between the lens diameter D and the maximum diameter Xr of the electron beam supplied to the lens is approximated by the following expression.

$$55Xr-20d=30 \quad (1)$$

In FIG. 5, the area showing the relationship between the beam spacing S and the maximum electron beam diameter Xr in the main lens in which no electron beam impinges upon the flat electrode in the cylindrical electrode is expressed as follows:

$$Xr \leqq S-2.1 \quad (2)$$

From the above expressions (1) and (2), the area showing the relationship between the beam spacing S and the lens aperture D in which no electron beam strikes the flat electrode in the cylindrical electrode is shown below by eliminating the maximum electron beam diameter Xr.

$$55S-20D \geqq 145.5 \quad (3)$$

The electron beam spot diameter on the fluorescent screen can be decreased by increasing the lens aperture up to the limit at which no electron beam strikes the flat electrode provided in the cylindrical electrode in the area under the straight line when the beams are large currents.

Moreover, it is possible to make the lens diameter D larger than the beam spacing S in the above area and the area where S=D is satisfied (shaded area in FIG. 6).

Thus, in the electron gun having the structure shown in FIGS. 3(*a*) and 3(*b*), values of the desired lens diameter D and the beam spacing S line in the shaded area in FIG. 6.

By adopting the relationship between the lens diameter D and the beam spacing S lying in the shaded area in FIG. 6, it is possible to make the main lens diameter larger than conventional ones within the limit that no electron beam impinges on the flat electrode installed in the cylindrical electrode whose openings are of approximately elliptic cross sections when the beams are large currents without causing any problem on the convergence of three electron beams.

EMBODIMENT 1

An embodiment of the present invention will be described below in detail, referring to the drawings.

Figure 7:
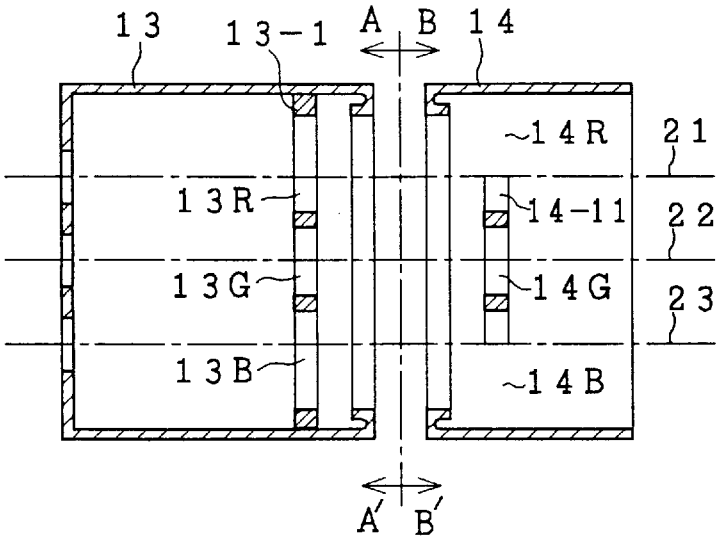
FIGS. 7(*a*)–(*c*) are sectional views of an essential portion showing the main lens of an in-line electron gun, illustrating an embodiment of a cathode ray tube equipped with an in-line electron gun of the present invention.
Figure 7:
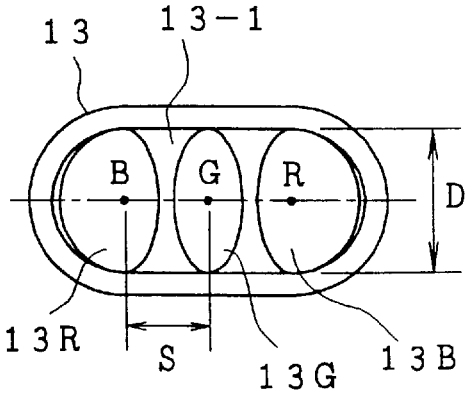
Figure 7:
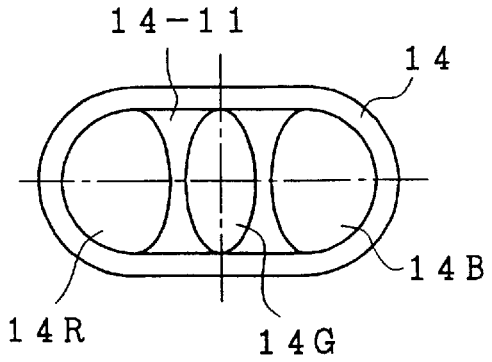

FIGS. 7(*a*)–(*c*) are sectional views of the essential portion of the main lens of an in-line electron gun, illustrating an embodiment of a cathode ray tube equipped with an in-line electron gun of the present invention, in which FIG. 7(*a*) is a longitudinal sectional view of the essential portion in the in-line direction, FIG. 7(*b*) is a transverse sectional view of the essential portion viewed from the line A-A' in FIG. 7(*a*), and FIG. 7(*c*) is a transverse sectional view of the essential portion viewed from the line B-B' in FIG. 7(*a*).

In FIGS. 7(*a*)–(*c*), reference numeral 13 is a third grid electrode constituting a main lens, 13-1 is a flat electrode installed in the third grid electrode 13, 13R, 13G, and 13B are color electron beam passing holes, 14 is a fourth grid electrode constituting a main lens, symbol 14-11 is a flat electrode installed in the fourth grid electrode 14, and 14R, 14G, and 14B are color electron beam passing areas.

The electron beam passing area 14G at the center of the flat electrode 14-11 is an opening and the electron beam passing areas 14R and 14B for side beams are electron beam passing holes enclosed by the cutaways of the flat electrode 14-11 and the inner wall of the fourth grid electrode 14. The openings of the third grid electrode 13 and those of the fourth grid electrode 14 have the same shapes. Moreover, the same numerals as those in FIGS. 3(*a*)–(*b*) correspond to the same parts.

In FIGS. 7(*a*)–(*c*), the beam spacing S between the centers of adjacent electron beams entering the main lens is 4.75 mm and the diameters D in the direction perpendicular to the row of three electron beams at the openings, of the third grid electrode 13 and fourth grid electrode 14, are 5.5 mm.

In the case of the above dimensions, the relationship between the beam spacing S of adjacent electron beams entering the main lens and the diameter D in the direction perpendicular to the row of three electron beams at the openings of the third grid electrode 13 and fourth grid electrode 14 meet the condition represented by the shaded area in FIG. 6. In this case, the spherical aberration of the main lens become almost the same as that of a cylindrical lens having a diameter of 5.5 mm and thus no problem arises in the convergence of three electron beams and no electron beam strikes the flat electrode 13-1 in the third grid electrode 13 when the beams are large currents. Therefore, it is possible to greatly decrease the electron beam spot diameter at the fluorescent screen compared with conventional ones.

As described above, the present invention provides a color cathode ray tube having an in-line electron gun, in which a large diameter lens can be obtained by optimizing the diameter orthogonal to the arrangement of the three electron beams passing through an electrostatic focusing electrode constituting the main electrode of the in-line electron gun, and which can reproduce an image of high definition.

The following is the description of a color cathode ray tube in which the influence of a neck inner wall potential is eliminated and the static convergence drift for a long-time operation is decreased.

Figure 8:
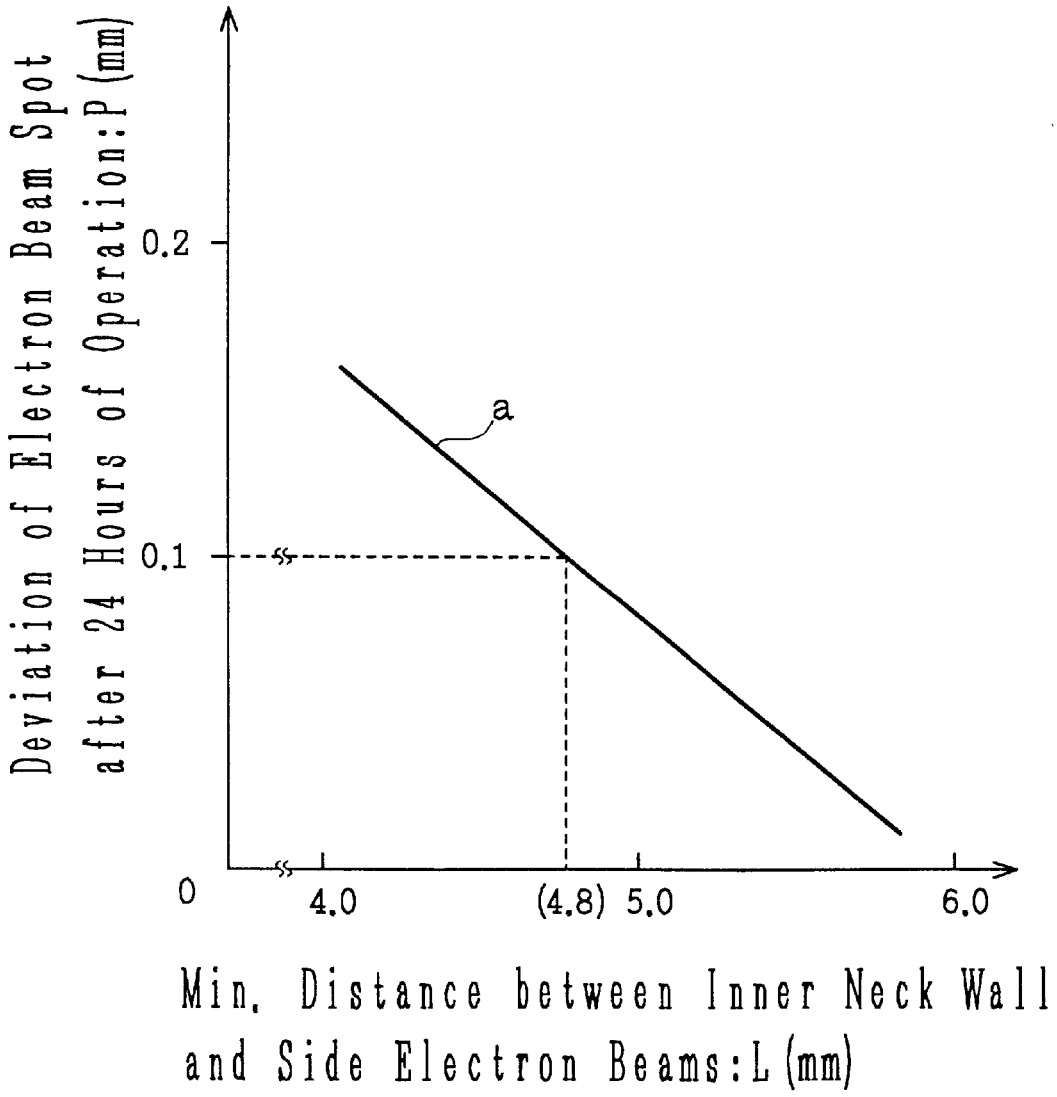
FIG. 8 is a graph showing the relationship between the distance L (mm) from the axes of the side beam among three electron beams to the inner wall of a neck and the electron beam movement P (mm) on the fluorescent screen after 24-hour operation.

FIG. 8 is a graph showing the relationship between the distance L (mm) from the central axes of the side electron beams among three electron beams to the neck inner wall and the electron beam movement distance P (mm) on the fluorescent screen after 24-hr operation, in which the abscissa indicates the minimum distance L (mm) between electron beam central axes and neck inner wall and the ordinate indicates the movement distance P (mm) after 24-hr operation.

The straight line "a" shown in FIG. 8 is expressed as follows:

$$P=-0.12L+0.66$$

In general, it is known that 0.1 mm or less of the electron beam movement distance P after 24-hour operation is practically acceptable. Therefore, it is possible to keep the electron beam movement distance P (mm) after 24-hour operation in the practical range by determining the distance L (mm) from the center of the side electron beam to the neck inner wall to be 4.8 mm or more.

Let the thickness of the glass constituting the neck be "h" (mm), the outside diameter T (mm) of the neck is obtained from the following expression.

$$T=(S+L+h)\times 2$$

A through-hole is formed by electric discharge penetrating the neck glass. To prevent such a through-hole, so-called neck glass penetration, the thickness h (mm) of the glass neck is required to be 2.5 mm or more. Therefore, it is possible to keep the electron beam movement distance P after 24-hour operation in the acceptable range by so determining the outside diameter T (mm) of the neck c;lass and the beam spacing S (mm) that they meet the following expression.

$$2S+14.6 \leqq T$$

Figure 9:
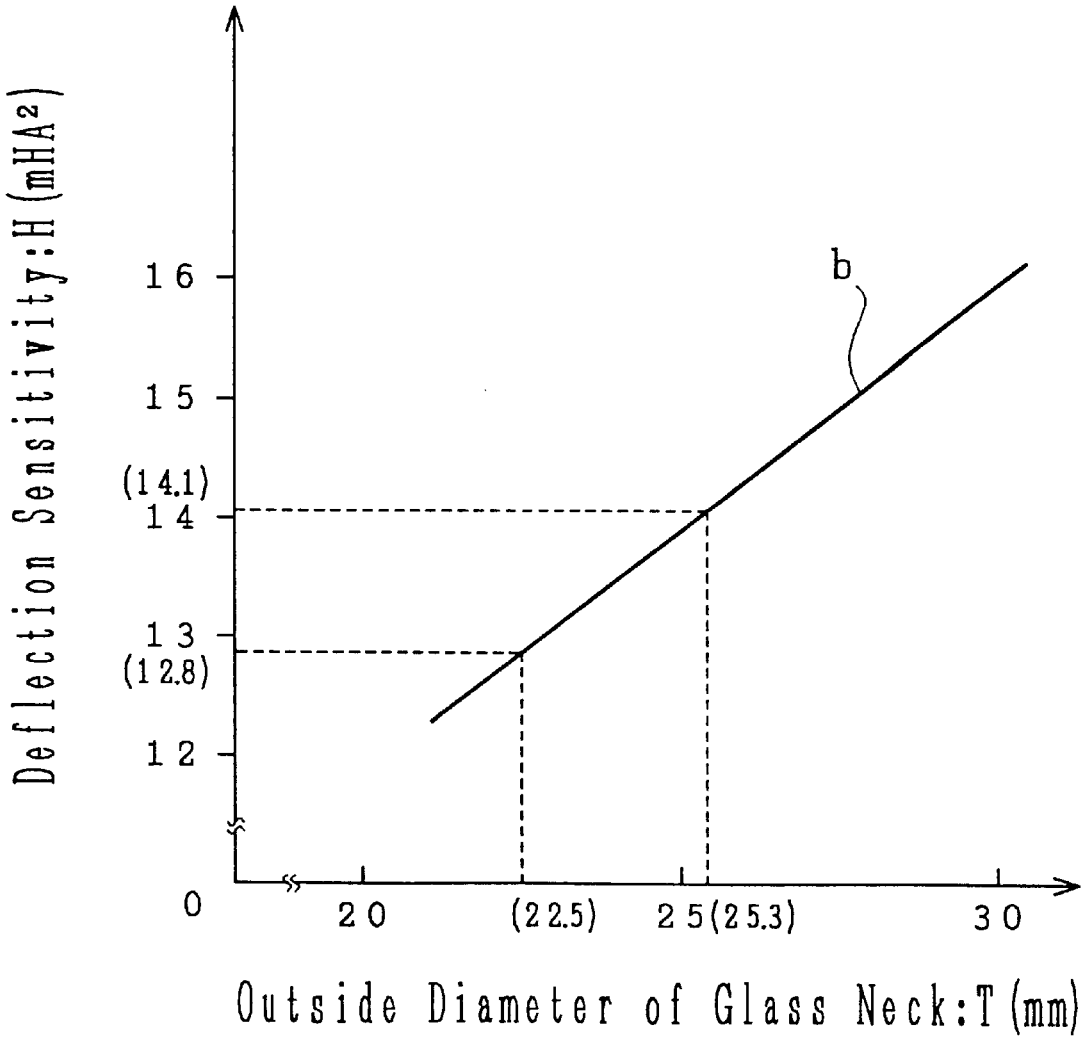
FIG. 9 is a graph showing the relationship between the outside diameter T of neck glass and the deflection sensitivity H ($mHA^2$) of the deflection yoke, in which the ordinate indicates the outside diameter T of the neck glass and the abscissa indicates the deflection sensitivity H ($mHA^2$) of the deflection yoke.

FIG. 9 is a graph showing the relationship between the outside diameter T of the neck glass and the deflection sensitivity H of the deflection yoke, in which the abscissa indicates the outside diameter T of the neck glass and the ordinates indicates the deflection sensitivity H ($mHA^2$) of the deflection yoke.

The straight line "b" shown in FIG. 9 is expressed as follow:

$$H=0.46T+2.4$$

Because the outside diameter T of the neck glass of a conventional so-called mini-neck picture tube superior in the deflection sensitivity is 22.5 mm, the deflection sensitivity H is 12.8 $mHA^2$. When the degradation of deflection sensitivity is from approximately 10 to approximately 20% down from the above deflection sensitivity, it is unnecessary to greatly modify the deflection current generation circuit of a television set using a conventional mini-neck picture tube. That is, the deflection sensitivity of up to the range of 14.1 to 15.4 $mHA^2$ in FIG. 9 is in the practical range.

Therefore, when the neck glass has an outside diameter of 25.3 mm or less, 26.7 mm or less, or 28.1 mm or less, it is possible to set a deflection sensitivity H in a practical range. Moreover, by modifying the constitution of the deflection yoke, it is possible to suppress the decrease of the deflection sensitivity below 10%, 15%, or 20%, respectively, in the case of such a degree of increase in neck diameter.

To effectively use the main lens aperture of an in-line electron gun, the diameter of the electron beam supplied to the main lens must be increased as the main lens diameter increases so that the beam spot on the fluorescent screen is prevented from enlarging due to the space charge effect. However, if the electron beam diameter in the main lens is excessively increased, this causes the beam spot diameter at the fluorescent screen to increase due to the lens aberration. That is, the electron beam diameter in the main lens has an optimum value. Therefore, as described above, the straight line "a" in FIG. 6 or the above expression (3) is obtained.

In the case of a cylindrical electrode, the lens diameter D (mm) corresponds to the diameter D in the vertical direction (direction orthogonal to the arrangement direction of the in-line gun) of the opening of the cylindrical electrode. In the case of an electrode having three circular openings, the lens aperture D (mm) corresponds to the diameter D of the circular openings.

When the relation between the beam spacing S and the lens diameter is in the area under the straight line "a", no electron beam strikes the electrode when the beams are large current flows. However, if the lens diameter is smaller than 3.9 mm, the electron beam spot diameter increases too much and this would cause a problem. Therefore, the lens diameter must be 3.9 mm or larger. Moreover, the dimension S must be 4.1 mm or larger.

By meeting all the above conditions, the electron beam movement distance P after 24-hour operation can be in a practical range and in a range in which the deflection sensitivity H is at a practical level, no electron beam impinges upon the electrode, and electron beam spot diameter can be minimized.

EMBODIMENT 2

Another embodiment of a cathode ray tube of the present invention equipped with an in-line electron gun will be described below, referring to the drawings.

Figure 1:
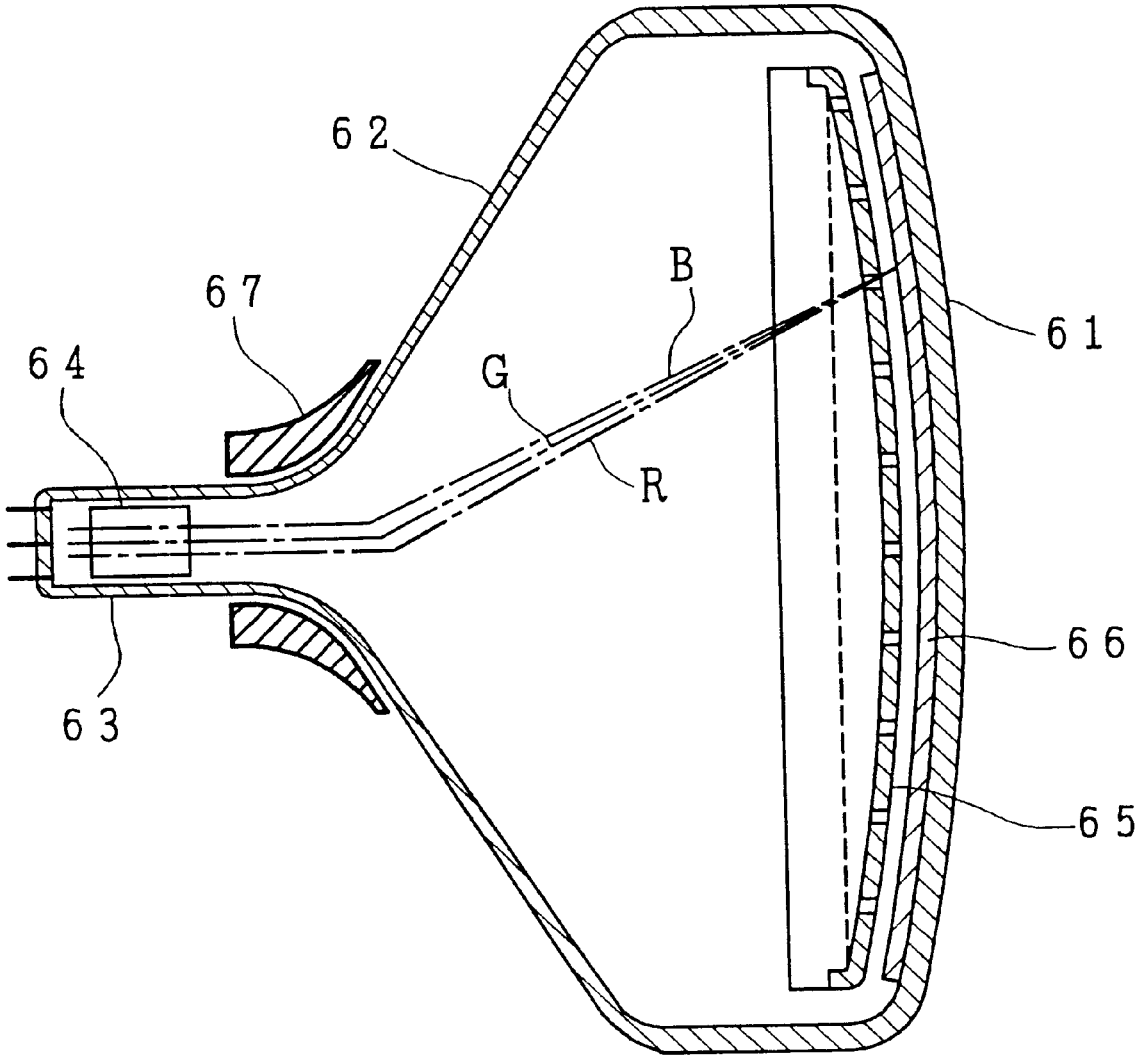
FIG. 1 PRIOR ART
FIG. 1 is a sectional view for schematically illustrating the structure of an in-line color cathode ray tube to which the present invention is applied.
Figure 2:
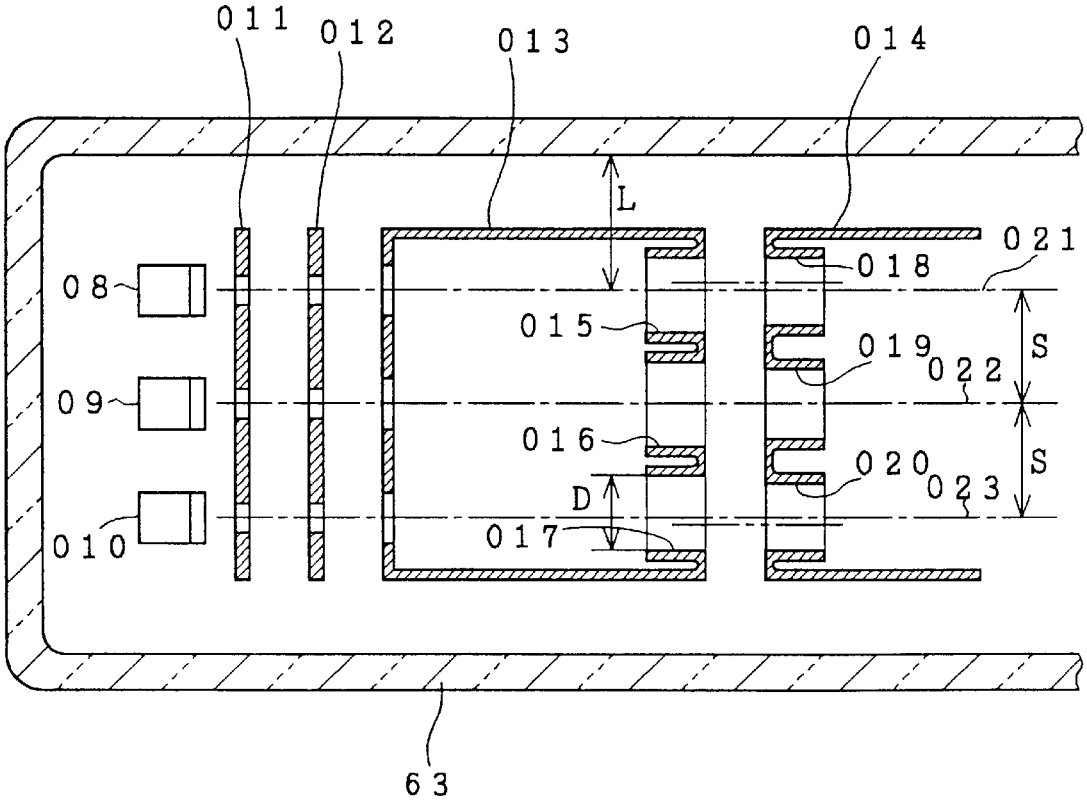
FIG. 2 PRIOR ART
FIG. 2 is a sectional view of an essential view of an essential portion of the main lens, schematically illustrating the structure of a conventional in-line electron gun used for the cathode ray tube shown in FIG. 1.
Figure 10:
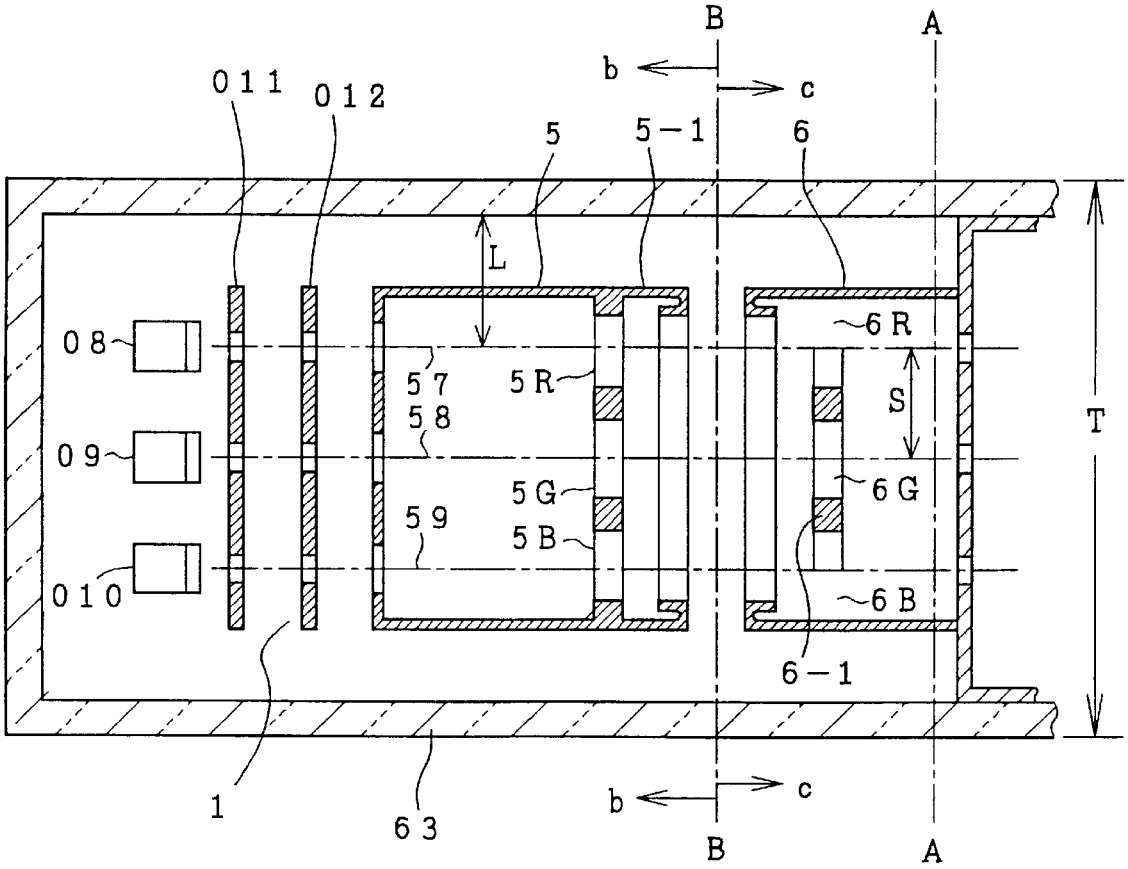
FIG. 10 is a sectional view of an essential portion in the tube axis direction, illustrating an embodiment of a cathode ray tube equipped with an in-line electron gun of the present invention.

FIG. 10 is a sectional view of the essential portion in the tube axis direction similarly to FIG. 2, illustrating the embodiment of the cathode ray tube equipped with the in-line electron gun of the present invention.

In FIG. 10, numeral 1 is an in-line electron gun housed in a neck 63; 08, 09, and 010 are cathodes; 011 is a G1 electrode; 012 is a G2 electrode; 5 is a G3 electrode which is one of the electrodes constituting a main lens, 6 is a G4 electrode which is the other electrode constituting the main lens; 57, 58, and 59 are central axes of electron beams; S-1 is a flat electrode set in the G3 electrode 5; 5R, 5G, and 5B are electron beam passing holes formed in the flat electrode 5-1; 6-1 is a flat electrode set in lhe G4 electrode 6; and 6R, 6G, and 6B are electron beam passing holes formed in the flat electrode 6-1.

Figure 11:
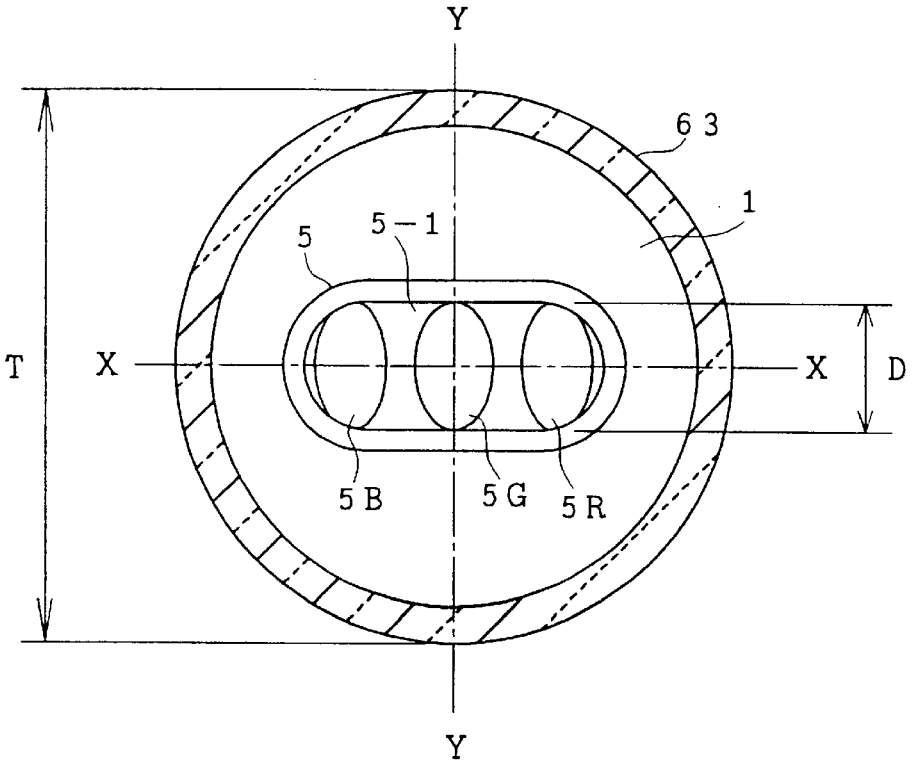
FIG. 11 is a sectional view in the direction perpendicular to the tube axis, viewed from the line B—B in the direction indicated by the arrows b, b in FIG. 10.
Figure 12:
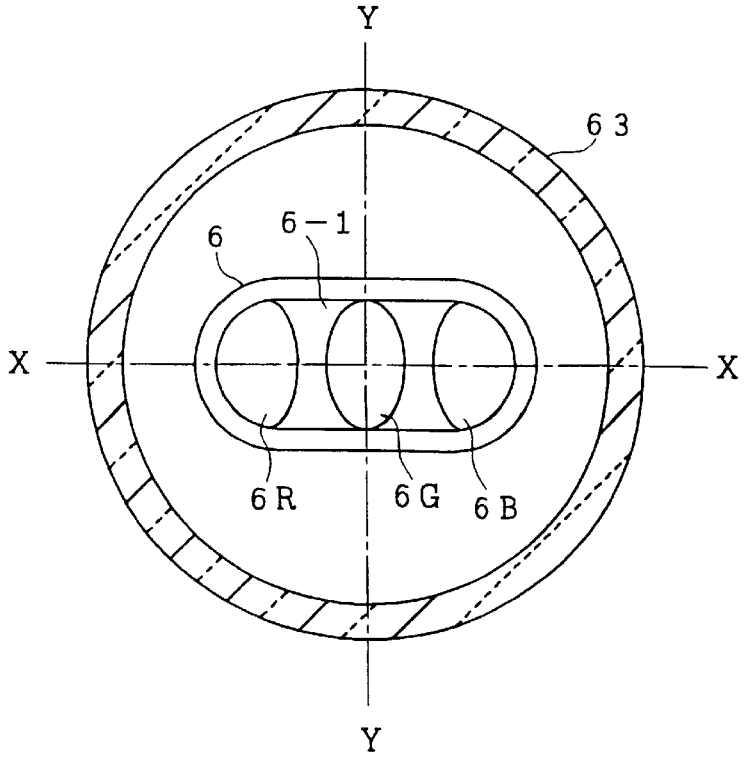
FIG. 12 is a sectional view of the principal portion in the direction orthogonal to a tube axis, viewed from the line B—B in the direction indicated by the arrows c, c in FIG. 10.

FIG. 11 is a sectional view of the essential portion in the direction orthogonal to the tube axis, viewed from the line B—B in the direction indicated by the arrows b, b in FIG. 10. FIG. 12 is a sectional view of the essential portion in the direction orthogonal to the tube axis, viewed from the line B—B in the direction indicated by the arrows C—C in FIG. 10.

In FIGS. 10 to 12, the G3 electrode 5 is a cylindrical electrode whose opening cross section is approximately elliptic and the G4 electrode is also a cylindrical electrode whose opening cross section is approximately elliptic.

As shown in FIG. 11, electron beam passing holes 5R, 5G, and 5B for passing three electron beams are formed in the flat electrode 5-1 provided in the G3 electrode 5 in the horizontal direction (in-line gun arrangement plane) X—X.

The flat electrode 6-1 provided in the G4 electrode 6 has a central beam passing hole 6G at its center and the side electron beam passing holes 6R and 6B are formed by the inner wall of the G4 electrode 6 and each part of the cutaways on both sides in the X—X direction of the flat electrode 6-1. The mutually facing openings of the G3 electrode 5 and G4 electrode 6 have the same shape.

The outside diameter T (mm) of the neck 63 is 24.3 mm, the beam spacing S (mm) between the central axes 57, 58, and 59 of adjacent electron beams entering the main lens is 4.75 mm, and the diameter D (mm) in the direction perpendicular to the arrangement of the three electron beams, of the openings of the G3 electrode 5 and G4 electrode 6 serving as the main lens diameter is 5.5 mm. For these dimension, the following expression is obtained.

$$2S+14.6=2\times4.75+14.6=24.1$$

Therefore, the outside diameter T of the neck glass satisfies the following inequality.

$$2S+14.6\leqq T\leqq25.3$$

And, the dimension S is 4.75 mm which is larger than 4.1 mm.

Therefore, in this case, it is possible to keep the electron beam moving distance P (mm) after 24-hour operation in the practical range where the deflection sensitivity H ($mHA^2$) is practical, no electron beam strikes the electrode, and the electron beam spot diameter is so small as to be acceptable.

EMBODIMENT 3

The dimensions are the same as in Embodiment 2 except the following.

Outside diameter T of the neck=26.5 mm

Beam spacing S=5.5 mm

Diameter D of openings of the G3 and G4 electrodes=6.2 mm

Then, 2S+14.6=25.6.

The outside diameter T satisfies $2S+14.6\leqq T\leqq26.7$, and $S=5.5>4.1$.

The deflection sensitivity H is 14.7 $mHA^2$ according to FIG. 9 and its decrease from that of the above-mentioned mini-neck color picture tube is limited to less than 15%. This embodiment provides the advantages similar to Embodiment 2.

EMBODIMENT 4

The dimensions are the same as in Embodiment 2 except the following.

Outside diameter T of the neck=28.0 mm

Beam spacing S=6.6 mm

Diameter D of openings of the G3 and G4 electrodes=b·b mm

Then, 2S+14.6=27.8.

The outside diameter T satisfies $2S+14.6 \leqq T \leqq 28.1$ and $S=6.6>4.1$.

The deflection sensitivity H is 15.3 $mHA^2$ according to FIG. 9 and its decrease from that of the above-mentioned mini-neck color picture tube is limited to less than 20%. This embodiment provides the advantages similar to Embodiment 2.

As described above, the present invention can provide a color cathode ray tube equipped with an in-line electron gun having an excellent function of limiting the electron beam moving distance after a long-time operation in a practical range by determining the outside diameter T (mm) of the cathode ray tube and the beam spacing S (mm) between the centers of a plurality of adjacent electron beams in such a way that they meet the relationship, $2S+14.6 \leqq T \leqq 28.1$, and so determining the beam spacing S as to be 4.1 mm or larger that the deflection sensitivity is maintained in a practically range, no electron beam strikes the main lens electrode, and the electron beam spot diameter can be acceptably small.

What is claimed is:

1. A color cathode ray tube equipped with an in-line electron gun comprising three cathodes for emitting three adjacent electron beams of an in-line arrangement toward a fluorescent screen, and a main lens for focusing said three adjacent electron beams on the fluorescent screen, said main lens comprising two cylindrical electrodes arranged in a spaced relationship in a direction of an axis of said tube, each having an opening at opposing ends thereof and having therein a plate electrode with a beam passing area, said two cylindrical electrodes being given different voltages, wherein the following inequalities are satisfied;

$$2S+14.6 \leqq T \leqq 25.3$$

$$4.1 \leqq S$$

S being a beam spacing in mm between central axes of said three adjacent electron beams at said main lens, and T being an outside diameter of a neck portion of a vacuum envelope housing said in-line electron gun.

2. A color cathode ray tube according to claim 1, wherein each of said opposing ends of said two cylindrical electrodes comprises a common single opening for said three adjacent electron beams.

3. A color cathode ray tube according to claim 1, wherein the thickness in mm of said plate electrode extends in a direction of the axis of said tube.

4. A color cathode ray tube according to claim 2 or 3, wherein said plate electrode has at least an aperture for a center electron beam, said at least the aperture for the center electron beam having a smaller dimension in a direction of said in-line arrangement than a dimension of a direction perpendicular to the direction of said in-line arrangement.

5. A color cathode ray tube according to claim 4, wherein said at least the aperture for the center electron beam has an elliptical shape.

6. A color cathode ray tube equipped with an in-line electron gun comprising three cathodes for emitting three adjacent electron beams of an in-line arrangement toward a fluorescent screen, and a main lens for focusing said three adjacent electron beams on the fluorescent screen, said main lens comprising two cylindrical electrodes arranged in a spaced relationship in a direction of an axis of said tube, each having an opening at opposing ends thereof and having therein a plate electrode with a beam passing area, said two cylindrical electrodes being given different voltages, wherein the following inequalities are satisfied;

$$2S+14.6 \leqq T \leqq 26.7$$

$$4.1 \leqq S$$

S being a beam spacing in mm between central axes of said three adjacent electron beams at said main lens, and T being an outside diameter of a neck portion of a vacuum envelope housing said in-line electron gun.

7. A color cathode ray tube according to claim 6, wherein each of said opposing ends of said two cylindrical electrodes comprises a common single opening for said three adjacent electron beams.

8. A color cathode ray tube according to claim 6, wherein the thickness in mm of said plate electrode extends in a direction of the axis of said tube.

9. A color cathode ray tube according to claim 7 or 8, wherein said plate electrode has at least an aperture for a center electron beam, said at least the aperture for the center electron beam having a smaller dimension in a direction of said in-line arrangement than a dimension of a direction perpendicular to the direction of said in-line arrangement.

10. A color cathode ray tube according to claim 9, wherein said at least the aperture for the center electron beam has an elliptical shape.

11. A color cathode ray tube equipped with an in-line electron gun comprising three cathodes for emitting three adjacent electron beams of in-line arrangement toward a fluorescent screen, and a main lens for focusing said three adjacent electron beams on the fluorescent screen, said main lens comprising two cylindrical electrodes arranged in a spaced relationship in a direction of an axis of said tube, each having an opening at opposing ends thereof and having therein a plate electrode with a beam passing area, said two cylindrical electrodes being given different voltages, wherein the following inequalities are satisfied, $$2S+14.6 \leqq T \leqq 28.1$$

$$4.1 \leqq S$$

S being a beam spacing in mm between central axes of said three adjacent electron beams at said main lens, and T being an outside diameter of a neck portion of a vacuum envelope housing said in-line electron gun.

12. A color cathode ray tube according to claim 11, wherein each of said opposing ends of said two cylindrical electrodes comprises a common single opening for said three adjacent electron beams.

13. A color cathode ray tube according to claim 11 wherein the thickness in mm of said plate electrode extends in a direction of the axis of said tube.

14. A color cathode ray tube according to claim 12 or 13, wherein said plate electrode has at least an aperture for a center electron beam, said at least the aperture for the center electron beam having a smaller dimension in a direction of said in-line arrangement than a dimension of a direction perpendicular to said direction of in-line arrangement.

15. A color cathode ray tube according to claim 14, said at least the aperture for the center electron beam has an elliptical shape.

16. A color cathode ray tube equipped with an in-line electron gun comprising three cathodes for emitting three adjacent electron beams of an in-line arrangement toward a fluorescent screen, and a main lens for focusing said three adjacent electron beams on the fluorescent screen, said main lens comprising two cylindrical electrodes arranged in a spaced relationship in a direction of an axis of said tube, each having an opening at opposing ends thereof and having therein a plate electrode with a beam passing area, said two cylindrical electrodes being given different voltages, wherein an outside diameter of a neck of a vacuum envelope housing said in-line electron gun is substantially 24.3 mm, and a beam spacing between a central axis of said three adjacent electron beams at said main lens is at least 4.1 mm.

17. A color cathode ray tube according to claim 16, wherein each of said opposing ends of said two cylindrical electrodes comprises a common single opening for said three adjacent electron beams.

18. A color cathode ray tube according to claim 16, wherein the thickness in mm of said plate electrode extends in a direction of the axis of said tube.

19. A color cathode ray tube according to claim 17 or 18, wherein said plate electrode has at least an aperture for a center electron beam, said at least the aperture for the center electron beam having a smaller dimension in a direction of said in-line arrangement than a dimension of direction perpendicular to said direction of in-line arrangement.

20. A color cathode ray tube according to claim 19, wherein said at least the aperture for the center electron beam has an elliptical shape.

21. A color cathode ray tube equipped with an in-line electron gun comprising three cathodes for emitting three adjacent electron beams of an in-line arrangement toward a fluorescent screen, and a main lens for focusing said three adjacent electron beams on the fluorescent screen, said main lens comprising two cylindrical electrodes arranged in a spaced relationship in a direction of an axis of said tube, said two cylindrical electrodes being given different voltages, wherein an outside diameter of a neck of a vacuum envelope housing said in-line electron gun is substantially 24.3 mm, and a beam spacing between a central axis of said three adjacent electron beams at said main lens is substantially equal to or less than 5 mm.

22. A color cathode ray tube equipped with an in-line electron gun comprising three cathodes for emitting three adjacent electron beams of an in-line arrangement toward a florescent screen, and a main lens for focusing said three adjacent electron beams on the fluorescent screen, said main lens comprising two cylindrical electrodes arranged in a spaced relationship in a direction of an axis of said tube, each having an opening at opposing ends thereof and having therein a plate electrode with a beam passing area, said two cylindrical electrodes being given different voltages, wherein an outside diameter of a neck of a vacuum envelope housing said in-line electron gun is substantially 24.3 mm, and a beam spacing between a central axis of said three adjacent electron beams at said main lens is substantially equal to or less than 5 mm.

23. A color cathode ray tube according to claim 22, wherein each of said opposing ends of said two cylindrical electrodes comprises a common single opening for said three adjacent electron beams.

24. A color cathode ray tube according to claim 22, wherein the thickness in mm of said plate electrode extends in a direction of the axis of said tube.

25. A color cathode ray tube according to claim 23 or 24, wherein said plate electrode has at least an aperture for a center electron beam, said at least the aperture for the center electron beam having a smaller dimension in a direction of said in-line arrangement than a dimension of a direction perpendicular to said direction of in-line arrangement.

26. A color cathode ray tube according to claim 25, wherein said at least the aperture for the center electron beam has an elliptical shape.

27. A color cathode ray tube equipped with an in-line electron gun comprising three cathodes for emitting three adjacent electron beams of an in-line arrangement toward a fluorescent screen, and a main lens for focusing said three adjacent electron beams on a fluorescent screen, said main lens comprising two cylindrical electrodes arranged in a spaced relationship in a direction of an axis of said tube, each having an opening and having therein a plate electrode with a beam passing area in a direction parallel to said in-line arrangement of said three electron beam;

said two cylindrical electrodes being given different voltages, wherein D and S have values in a region where all of the following inequalities are satisfied, $$S \leqq 5.0$$

$$S > D,$$

and $$145.5 \leqq 55S - 20D$$

S being a beam spacing in mm between central axes of said three adjacent electron beams at the main lens, and D being a dimension in mm related to a distance of a center of at least one of said in-line arrangement of the three adjacent electron beams to an inner edge of at least one of said two cylindrical electrodes.

28. A color cathode ray tube according to claim 27, wherein said D has a value of twice a dimension in mm between a center of a side electron beam and a nearer edge of said cross section of the opening at an opposing end of one of said two cylindrical electrodes.

29. A color cathode ray tube according to claim 27, wherein said D is a diameter in mm in a direction perpendicular to said in-line arrangement of said three electron beams of said cross section of the opening at opposing ends of said two cylindrical electrodes, said plate electrode has at least an aperture for a center electron beam, and said at least the aperture of the center electron beam has a smaller dimension in a direction of said in-line arrangement than a dimension in a direction perpendicular to the direction of said in-line arrangement.

30. A color cathode ray tube according to claim 28, wherein each of said opposing ends of said two cylindrical electrodes comprises a common single opening for said three adjacent electron beams.

31. A color cathode ray tube according to claim 30, wherein the thickness in mm of said plate electrode extends in a direction of the axis of said tube.

32. A color cathode ray tube according to claim 31, wherein said plate electrode has at least an aperture for a center electron beam, said at least the aperture for the center electron beam having a smaller dimension in a direction of said in-line arrangement than a dimension in a direction perpendicular to the direction of said in-line arrangement.

33. A color cathode ray tube according to claim 32, wherein said at least the aperture for the center electron beam has an elliptical shape.

34. A color cathode ray tube according to one of claims 27–33, wherein an outside diameter of a neck portion of a vacuum envelope accommodating said in line electron gun is less than 25.3 mm.

35. A color cathode ray tube according to one of claims 27–33, wherein an outside diameter of a neck portion of a vacuum envelope accommodating said in-line electron gun is less than 26.7 mm.

36. A color cathode ray tube according to one of claims 27–33, wherein an outside diameter of a neck portion of a vacuum envelope accommodating said in-line electron gun is less than 28.1 mm.

37. A color cathode ray tube according to one of claims 27–33, wherein an outside diameter of a neck portion of a vacuum envelope accommodating said in-line electron gun is substantially 24.3 mm.

* * * * *

UNITED STATES PATENT AND TRADEMARK OFFICE

CERTIFICATE OF CORRECTION

PATENT NO : 5,909,079

DATED : June 1, 1999

INVENTOR(S) : Go UCHIDA et al.

It is certified that error appears in the above-identified patent and that said Letters Patent is hereby corrected as shown below:

Col. 14, line 25
replace "S>D,"
with --S<D,--.

Signed and Sealed this

Second Day of November, 1999

*Attest:*

Q. TODD DICKINSON

*Attesting Officer*

*Acting Commissioner of Patents and Trademarks*